US005469838A

United States Patent [19]

Broadbent et al.

[11] Patent Number: 5,469,838

[45] Date of Patent: Nov. 28, 1995

[54] GAS FIREPLACE CAPABLE OF BEING INSTALLED WITHOUT MASONRY WORK

[76] Inventors: Lynn C. Broadbent, 1590 N. Fort Canyon; Craig L. Broadbent, 1520 N. Fort Canyon, both of Alpine, Utah 84004

[21] Appl. No.: 276,916

[22] Filed: Jul. 19, 1994

Related U.S. Application Data

[63] Continuation of Ser. No. 965,902, Oct. 23, 1992, Pat. No. 5,329,915.

[51] Int. Cl.[6] ..... F24B 1/188

[52] U.S. Cl. ..... 126/524; 126/500; 126/503; 126/512

[58] Field of Search ..... 126/503, 524, 126/500, 512

[56] References Cited

U.S. PATENT DOCUMENTS

| | | | |
|---|---|---|---|
| 2,671,440 | 3/1954 | Dupler | 126/524 X |
| 3,831,582 | 8/1974 | Mahoney | 126/503 X |
| 4,250,867 | 2/1981 | Anderson et al. | 126/502 |
| 4,793,322 | 12/1988 | Shimek et al. | 126/503 X |
| 4,836,182 | 6/1989 | Trowbridge | 126/524 X |

*Primary Examiner*—Larry Jones
*Attorney, Agent, or Firm*—Mallinckrodt & Mallinckrodt

[57] ABSTRACT

An enclosed gas fireplace which efficiently transfers heat from a combustion chamber to surrounding air chambers and to air flow conduits which pass through a flue gas offtake. The fireplace has an outer shell that remains relatively cool, so that the fireplace can be installed in a framed sheetrock or wood enclosure without the need for utilizing the special masonry work or masonry chimney normally required for a fireplace. In addition, the invention provides a special burner arrangement to enhance the aesthetic quality of the fire and which provides a clean-burning gas flame to meet modern emission standards.

2 Claims, 4 Drawing Sheets

GAS FIREPLACE CAPABLE OF BEING INSTALLED WITHOUT MASONRY WORK

This is a continuation of application Ser. No. 07/965,902, filed Oct. 23, 1992, now U.S. Pat. No. 5,329,915.

BACKGROUND OF THE INVENTION

1. Field

The invention is in the field of fireplaces, particularly premanufactured gas fireplaces to be installed in buildings without the need for masonry work.

2. State of the Art

Many people enjoy sitting in front of a fireplace and watching a fire. With the present concern about air pollution, many areas have put restrictions or complete bans on wood fires in wood burning fireplaces which generally produce polluting smoke. Also, with the present concern for energy conservation, people restrict use of conventional fireplaces where it is recognized that more heat from a building goes up the chimney than is produced by the fire. Such fireplaces are generally inefficient in producing heat, and the use of gas logs in such fireplaces is seen as merely a waste of gas.

U.S. Pat. No. 4,250,867 shows a wood burning fireplace around which air is circulated to heat the air. The heated air is then blown into the room. Thus, the fireplace is used to effectively heat the room. Since the air to be heated is drawn in to the fireplace from outside the building and then forced as heated air into the room, a positive pressure of air is created which keeps cold air from entering the room through various cracks, particularly about windows and doors. A normal fireplace when in use will lower the air pressure in a room, since air is drawn out through the chimney. This means that cold air will be drawn into the room through the aforementioned building cracks.

The fireplace of U.S. Pat. No. 4,250,867, however, leaves room for improvement in the efficiency of heat transfer to the circulating air. Although it is said that the apparatus can be used as a free standing unit, it requires special masonry work for installation.

SUMMARY OF THE INVENTION

According to the invention, outside air is circulated around an enclosed gas fireplace as it is, in general, in the aforementioned patent, but in such a manner that a more efficient transfer of heat is achieved. This is accomplished primarily by reason of the fact that the air circulation chambers surrounding the combustion chamber containing the fireplace fixture, are differently oriented, that a series of air flow conduits pass through the upper part of the firebox under and adjacent to the top wall thereof, oriented, and that provision is made for circulating flue gases from the combustion chamber over almost the entire extent of the top wall of the firebox through the series of air flow conduits.

The fireplace outer shell remains relatively cool so that the fireplace can be installed in a framed sheetrock or wood enclosure without the need for utilizing the special masonry work or masonry chimney normally required for a fireplace. In addition, the invention provides a special burner arrangement to enhance the aesthetic quality of the fire and which provides a clean burning gas flame to meet modern emission standards.

THE DRAWINGS

The best mode presently contemplated for carrying out the invention commercially is illustrated in the accompanying drawings, in which:

FIG. 1 represents a perspective view of gas fireplace apparatus according to the invention shown with the outer walls partially broken away;

FIG. 2, a perspective view from the rear of the apparatus of FIG. 1;

FIG. 3, a vertical section taken along the line 3—3 of FIG. 2;

FIG. 4, a horizontal section taken along the line 4—4 of FIG. 3; and FIG. 5, a perspective view of the special gas burner preferably employed as a part of the overall apparatus.

DETAILED DESCRIPTION OF THE ILLUSTRATED EMBODIMENT

Figure 1:
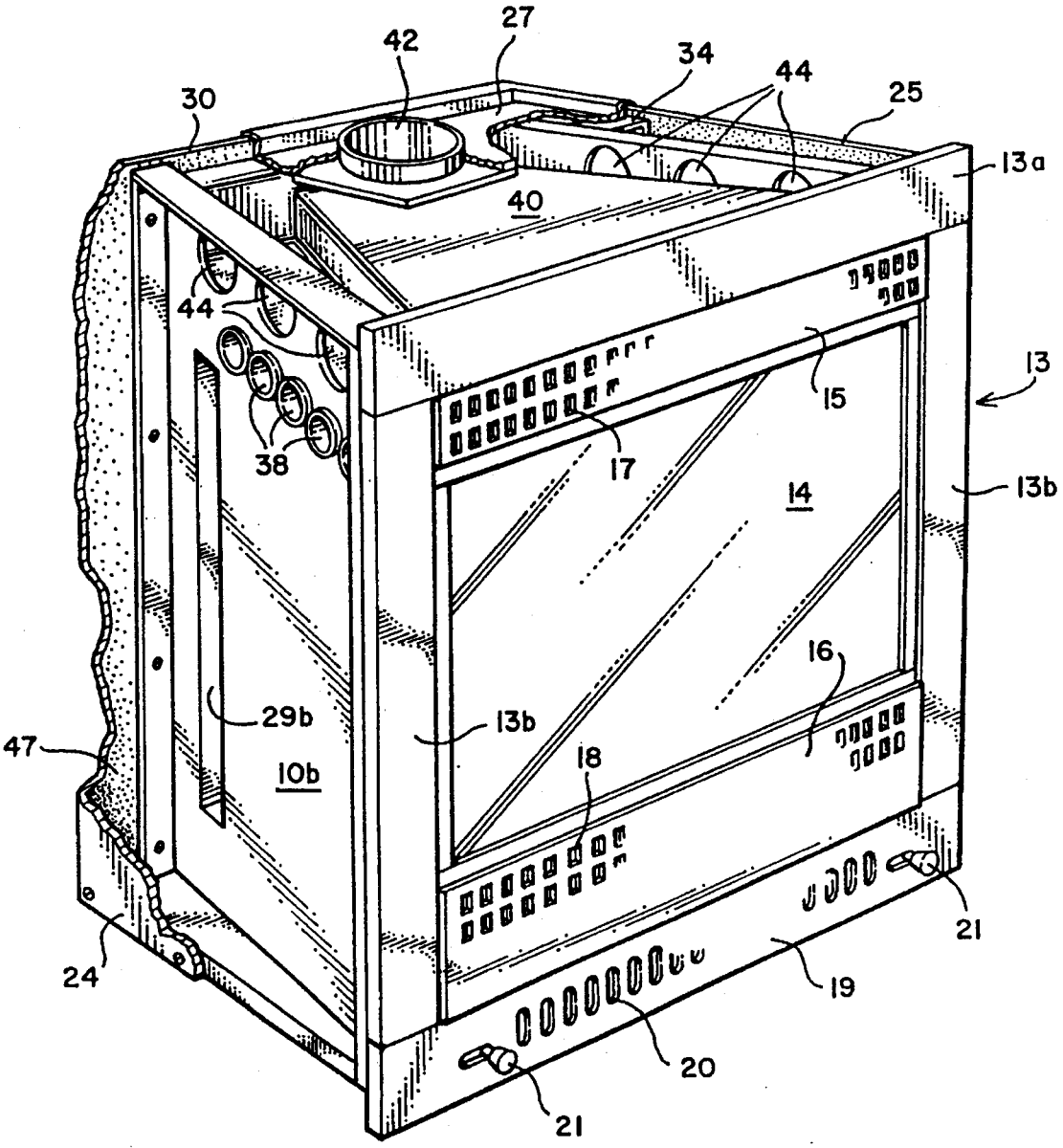
Figure 3:
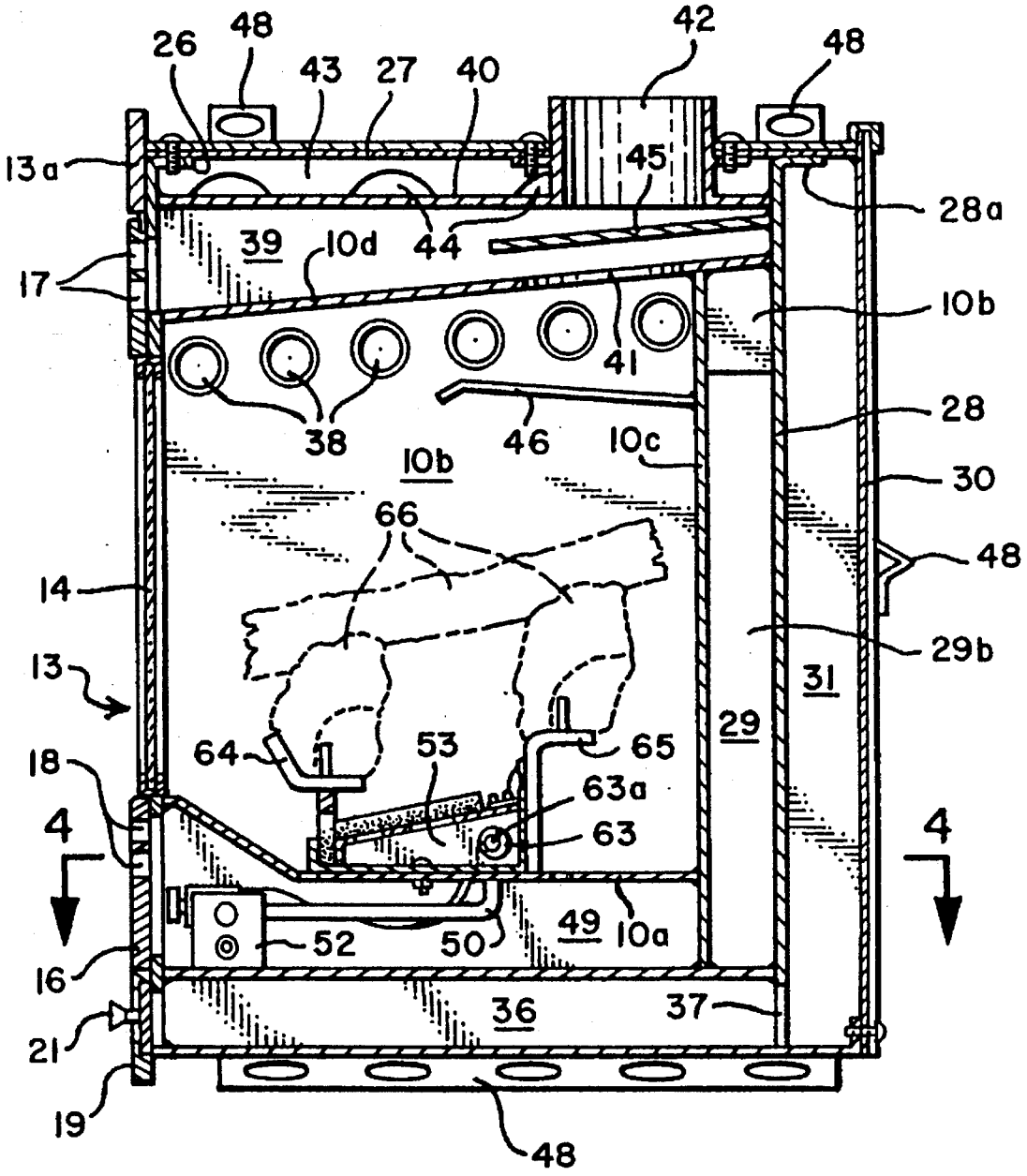
Figure 4:
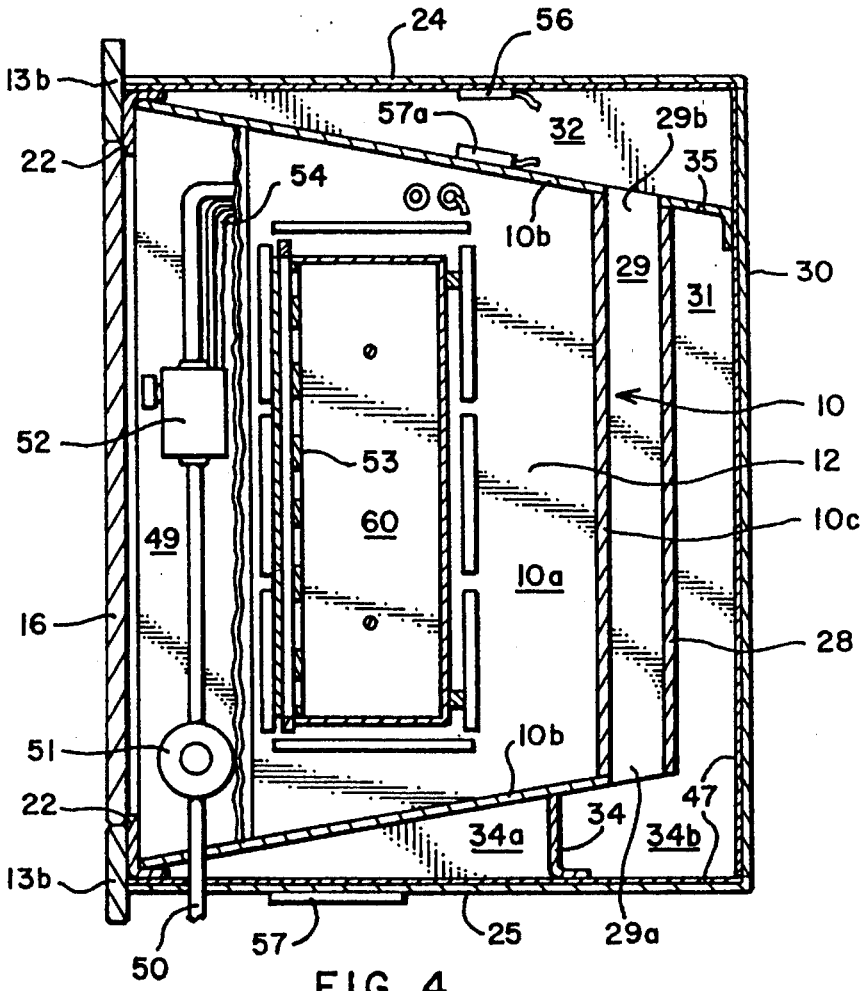

As illustrated, the gas fireplace apparatus of the invention comprises walls providing a firebox 10, of generally trapezoidal horizontal section defining a combustion chamber 12, as best shown in FIG. 4. Firebox 10 has a bottom wall 10*a*, sidewalls 10*b*, respectively, a back wall 10*c*, and a top wall 10*d*, FIG. 3. A front wall 13 for the apparatus provides a broad fireplace window 14, FIG. 1, upper panel 13*a* and side panels 13*b*, respectively. Fitted in is an upper panel 15 and a lower panel 16 having air openings 17 and 18, respectively. Below panel 16 is another panel 19 slotted with openings 20 and having a pair of handles 21 for opening and closing such openings. Secured to the back face of front wall 13 at the sides thereof are angles 22, FIG. 4, for the attachment of outer sidewalls 15, 24 and 25 and along the top a flange 26, FIG. 2, for the attachment of an outer top wall 27, FIG. 1 and 2.

Firebox 10 is surrounded on its sides, top, and back by air circulation chambers. Pressure air from the intake duct flows into and through air flow conduits 38 and top air-circulating chamber 43 and finally out into the room through bottom flow chamber 36 and openings 20 of panel 19. Thus, behind back wall 10*c* of the firebox is a partition wall 28, FIGS. 2, 3 and 4, which cooperates with firebox back wall 10*c* to form a back chamber 29 and with an outer back wall 30 of the apparatus to form a second back chamber 31. Partition wall 28 is flanged at its top, see 28*a*, FIG. 3, to support the back margin of outer top wall 27. Between outer side wall 24, FIG. 4, and its confronting firebox side wall 10*b* is formed a side chamber 32, and at the opposite side of the apparatus between outer side wall 25 and its confronting firebox sidewall 10*b* is formed a similar side chamber divided transversely vertically by a wall 34 into non-communicating side front and side back subchambers 34*a* and 34*b*, respectively.

Figure 2:
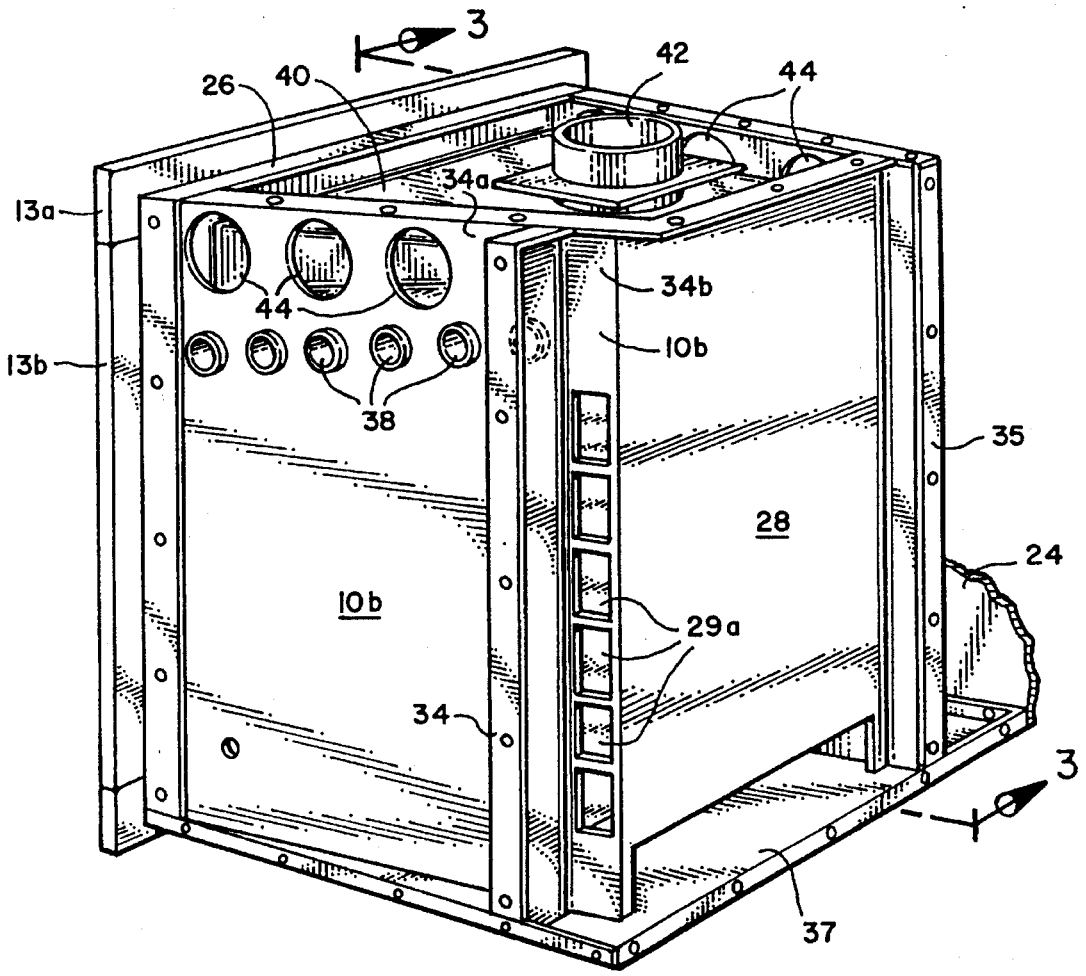

Back chamber 29 communicates along its height with side subchamber 34*b* as an air passageway by way of a vertical series of openings 29*a*, FIG. 2, and with side chamber 32 through a vertically elongate opening 29*b*, FIG. 3. The second back chamber 31 also communicates along its height with subchamber 34*b*, but is closed relative to chamber 32 by a wall 35 FIG. 4. It opens into a bottom chamber 36 through an opening 37, FIG. 3. Along the upper portion of the apparatus, front to back, but short of back wall 10*c* of firebox 10, and below upper wall 10*d* of the firebox, a series of air circulating pipes 38, FIG. 3, extend between side chamber 32 and side subchamber 34*a* and establish air flow communication therebetween. A flue chamber 39 is formed by a broad duct 40, FIG. 1, above firebox upper wall 10*d* for venting combustion gases from firebox 10 through opening 41, FIG. 3, in firebox upper wall 10*d* and for discharging such gases into and through outlet flue 42 and out of the room by a suitable stove pipe connection (not shown).

Defined by and between duct 40, the upper end portions of firebox side walls 10*b*, and outer top wall 27 of the apparatus is a top air-circulating chamber 43 that is open into both side chambers 32 and side subchamber 34*a* by means of ports 44.

A baffle plate 45, FIG. 3, is preferably provided above opening 41 so as to direct combustion gases passing through opening 41 toward the front of duct 40 to achieve heating throughout the road area comprehended by such duct. Also a baffle plate 46 is preferably positioned within firebox 10 to direct products of combustion along the line of airflow conduits 38. Plate 15 closes the front of duct 40, but is provided with openings 17 to vent any wind gusts coming down the flue rather than passing into firebox 10 to disturb the flames therein.

The outer walls of the apparatus are properly lined with an insulating material 47 so that the heated air circulating through the several air-circulating chambers will be effectively heated rather than heat being lost through the walls by radiation. This enables installation of the fireplace apparatus in a sheetrock wall of a room if desired.

For facilitating installation of the fireplace into the wall of a room, spacer bars 48 are attached along the outer bottom, outer back, and outer top walls to appropriately space the fireplace from construction materials, such as sheetrock. However, the unit could be made with an attractive finish on the outer walls for installation as a free standing unit.

As shown in FIGS. 3 and 4, an air intake chamber 49 receives gas supply pipes 50 and houses a pressure regulator 51 and control valve 52, standard furnace components. Access to control valve 52 is provided through access door 16 in front wall 13. The burner supply pipe leads to a gas burner 53 placed on bottom wall 10*a* of firebox 10. An electrical line 54 and pilot light feed line 55 run from the control valve and supply a thermocouple and pilot light in usual manner.

A limit switch 56 is located on the inside face of an outer wall and its insulation and is electrically connected to control valve 52. It turns off the gas if the temperature exceeds the safety limit, about 250° F. Connection 57 for an air intake duct is shown in FIG. 4 as leading from a source of air into side subchamber 34*a*. Means, such as a blower (not shown), for forcing pressurized air through the air intake duct at 57 may be provided, as may also a thermoswitch 57*a* for controlling operation of the blower. The thermoswitch can be set, for example, to turn the blower on when the temperature reaches 150° F. and turn the blower off when the temperature goes below 120° F.

Figure 5:
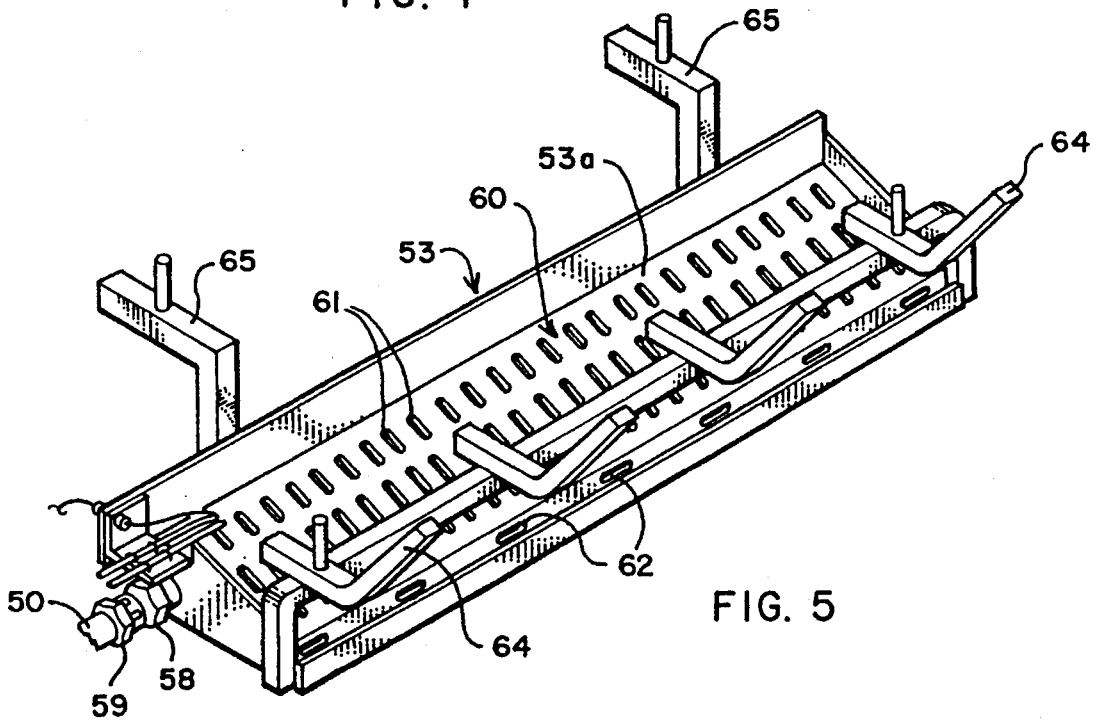

The gas supply pipe 50 passes up into the firebox where it is connected to an air valve 58, which allows air to enter the gas stream. The amount of air is adjustable by turning a nut 59. The gas burner 53 includes a substantially rectangular chamber 60, FIG. 4, open at the top with a bottom wall 53*a* that is slanted forwardly and downwardly, as indicated in FIG. 5. The top and front walls of the chamber have multiple slots 61 and 62, respectively, to allow for passage of the gas and air mixture. A pipe 63, FIG. 3, leads into and through burner chamber 60 and has a series of holes 63*a* on its top and sides to allow the gas and air mixture to fill the chamber 60. Attached to the front and rear margins of the gas burner are front and rear brackets 64 and 65, respectively, for holding ceramic logs 66, as indicated by broken lines in FIG. 3. These are hollowed out underneath, i.e., there is a front wall, side walls, and top wall, to provide an aesthetically pleasing interaction with the flames from the burner.

Air intake chamber 49 passes air, flowing thereinto, into firebox 10 through elongate slot openings 67, FIG. 4, provided in the bottom wall 10*a* of such firebox 10 surrounding burner 53.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A gas fireplace apparatus capable of being installed without masonry work, comprising a firebox enclosing a gas fireplace burner and provided with bottom, top, opposite side, front, and back walls and with a window in the front wall for viewing a fire burning in the fireplace; interconnecting, air circulating chambers laterally of, back of, and below said firebox, with inflow means for air to be heated and outflow means for the heated air; a series of spaced air flow conduits extending between and providing air flow communication between the laterally placed air circulating chambers, said series of spaced air flow conduits extending through said firebox from front to back thereof below but adjacent to the top wall of the firebox; and air inflow openings opening into said flue chamber.

2. A gas fireplace apparatus capable of being installed without masonry work, comprising a firebox enclosing a gas fireplace burner and provided with bottom, top, opposite side, front, and back walls and with a window in the front wall for viewing a fire burning in the fireplace; interconnecting air circulating chambers laterally of, back of, and below said firebox, with inflow means for air to be heated and outflow means for the heated air; a series of spaced air flow conduits extending between and providing air flow communication between the laterally placed air circulating chambers, said series of spaced air flow conduits extending through said firebox from front to back thereof below but adjacent to the top wall of the firebox; an upper duct defining a flue chamber immediately above the top wall of the firebox; and at least one air flow opening opening into the flue chamber to provide draft relief air and to vent any wind gusts entering such flue chamber.

* * * * *